US005576173A

United States Patent [19]

Parton et al.

[11] Patent Number: 5,576,173

[45] Date of Patent: Nov. 19, 1996

[54] PHOTOGRAPHIC ELEMENTS WITH J-AGGREGATING DICARBOCYANINE INFRARED SENSITIZING DYES

[75] Inventors: Richard L. Parton, Webster; Anthony Adin, Rochester, both of N.Y.

[73] Assignee: Eastman Kodak Company, Rochester, N.Y.

[21] Appl. No.: 501,889

[22] Filed: Jul. 13, 1995

Related U.S. Application Data

[63] Continuation-in-part of Ser. No. 304,038, Sep. 9, 1994, abandoned.

[51] Int. Cl.[6] ..... G03C 1/20; G03C 1/09

[52] U.S. Cl. ..... 430/584; 430/599; 430/601; 430/603; 430/604; 430/605; 430/567; 430/944

[58] Field of Search ..... 430/584, 591, 430/592, 567, 599, 601–605

[56] References Cited

U.S. PATENT DOCUMENTS

| | | | |
|---|---|---|---|
| 5,290,675 | 3/1994 | Hioki et al. | 430/584 |
| 5,296,343 | 3/1994 | Hioki et al. | 430/584 |
| 5,388,657 | 8/1994 | Kato et al. | 430/584 |

FOREIGN PATENT DOCUMENTS

| | | | |
|---|---|---|---|
| 0452853 | 10/1991 | European Pat. Off. | G03C 1/498 |
| 0531759 | 3/1993 | European Pat. Off. | G03C 1/12 |
| 0559195 | 9/1993 | European Pat. Off. . | |
| 0563860 | 10/1993 | European Pat. Off. . | |
| 0573650 | 12/1993 | European Pat. Off. . | |
| 4146428 | 10/1990 | Japan . | |
| 5249599 | 9/1993 | Japan | 430/591 |

*Primary Examiner*—Lee C. Wright
*Attorney, Agent, or Firm*—Edith A. Rice

[57] ABSTRACT

A silver halide photographic element comprising a silver halide emulsion layer sensitized with a sensitizing dye of formula (I) which provides a maximum sensitivity at greater than 700 nm and which emulsion layer has substantially no dye deaggregating compound therein:

(I)

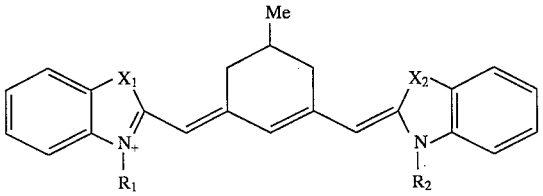

A wherein:

$X_1$ and $X_2$ are independently sulfur, selenium or oxygen provided that $X_1$ and $X_2$ are not both oxygen and either benzo ring may be substituted or unsubstituted;

$R_1$ and $R_2$ each independently represent an alkyl, aryl or heterocyclic group provided that at least one of $R_1$ or $R_2$ has an acid or acid salt substituent;

A is a counterion as needed to balance the charge.

16 Claims, No Drawings

PHOTOGRAPHIC ELEMENTS WITH J-AGGREGATING DICARBOCYANINE INFRARED SENSITIZING DYES

CROSS-REFERENCE TO RELATED APPLICATIONS

This is a Continuation-In-Part of application Ser. No. 08/304,038, filed Sep. 9, 1994, now abandoned, entitled "Photographic Elements With J-Aggregating Dicarbocyanine Infrared Sensitizing Dyes" by Richard L. Parton and Anthony Adin, the entire disclosure of which are incorporated herein by reference.

FIELD OF THE INVENTION

This invention relates to infrared light sensitive silver halide photographic elements.

BACKGROUND OF THE INVENTION

Silver halide is only inherently sensitive to ultraviolet ("UV") and blue light. It is well known that sensitizing dyes can be used to extend this sensitivity to the green and red regions. In some cases it is also advantageous to extend this sensitivity into the infrared region, for example to provide improved visual contrast in aerial photography. It has been reported that aerial films that are sensitized to infrared light (that is wavelengths beyond 700 nm) display better tonal separation (for example, sharp delineation of river bands, differentiation between clean and polluted surface water, and the like), better haze interpretation rendering the film of greater utility under poor weather conditions, and better performance during periods of restricted light (for example, early morning and late afternoon). For this application a sensitization maximum in the region of 720 to 730 nm is particularly desirable.

The advent of solid state diodes that emit in the infrared has also expanded the useful applications of infrared-sensitive photographic elements. These include making prints from digital information such as from computer assisted tomography scanners, various graphic arts products, and infrared-sensitive false color-sensitized photographic materials as described in U.S. Pat. No. 4,619,892.

Infrared sensitivity can be imparted by dicarbocyanine or tricarbocyanine dyes adsorbed to silver halide emulsions in the monomeric state. To encourage monomeric adsorption, deaggregants are frequently employed (for example, U.S. Pat. No. 5,108,882). However, at higher dye levels, which could provide-increased infrared speed, the deaggregants are unable to maintain the monomeric adsorbed dye state and increased infrared speeds are not obtained. Dyes which can form adsorbed long wavelength aggregates (sometimes called J aggregates) in the infrared are inherently capable of providing higher photographic speeds since higher dye levels enhance the aggregation process.

J-aggregating infrared dyes have a number of additional potential advantages over monomeric infrared sensitizers (see EP 0 531 759). J-aggregates have relatively narrow half-band widths which can result in better color separation and/or less safelight sensitivity when used in combination with emulsions sensitized at other wavelengths. It is also generally recognized that dye instability correlates with the length of the conjugated chain in cyanine dyes. Thus J-aggregating dicarbocyanine infrared dyes should be more stable than tricarbocyanine monomeric infrared sensitizers.

J-aggregating infrared dyes are rare. Benzoquinoline carbocyanine dyes combined with other carbocyanine dyes have been alleged to provide high infrared sensitivities (U.S. Pat. No. 3,615,634) but such benzoquinoline dyes suffer the disadvantages of being derived from the carcinogen B naphthylamine and having a peak sensitivity which is sensitive to emulsion morphology. On some emulsions, the peak sensitivity is close to 700 nm, which results in low infrared sensitivity. EP 0531 759 describes certain dicarbocyanine dyes which are stated to provide narrow J band sensitization peaking at wavelengths longer than 730 nm. However, such dyes do not always give acceptable infrared sensitization.

It would be desirable then, to have an infrared sensitizing dye which forms a J aggregate on various types of silver halide emulsions and therefore is not be used with deaggregating compounds.

SUMMARY OF THE INVENTION

Accordingly, the present invention provides a silver halide photographic element comprising a silver halide emulsion layer sensitized with a sensitizing dye of formula (I) to provide a maximum sensitivity at greater than 700 nm and which emulsion layer has substantially no dye deaggregating compound therein:

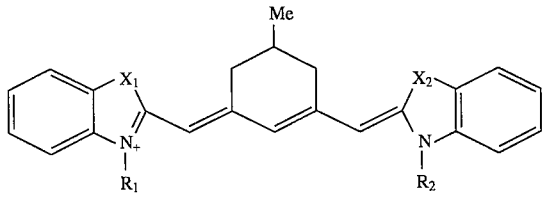

(I)

A wherein:

$X_1$ and $X_2$ are independently sulfur, selenium or oxygen provided that $X_1$ and $X_2$ are not both oxygen and either benzo ring may be substituted or unsubstituted;

$R_1$ and $R_2$ each independently represent an alkyl, aryl or heterocyclic group and at least one of $R_1$ and $R_2$ has an acid or acid salt substituent;

A is a counterion as needed to balance the charge.

Dicarbocyanine dyes of formula (I), have previously been found to provide spectral sensitization in the long red region (that is, at less than 700 nm) when used in conjunction with deaggregants and high chloride emulsions. However, such dyes have now been surprisingly found to provide high speeds and selective sensitization in the short infrared with a peak sensitivity particularly at less than about 730 nm when used without deaggregants (so as to form a J-aggregate on the emulsion) and on silver halide emulsions which are not necessarily of high chloride content.

EMBODIMENTS OF THE INVENTION

In the dye of formula (I), preferably only one of $R_1$ and $R_2$ has an acid or acid salt substituent when either of the benzo rings shown does not have an aromatic or heterocyclic substituent. Further preferably, only one of $R_1$ or $R_2$ has an acid or an acid salt substituent (such that the dye molecule of formula (I) therefore would have no net charge, that is, it is zwitterionic). More particularly both of $R_1$ or $R_2$, but preferably only one of them, is an alkyl group substituted with such an acid or acid salt group such as sulfomethyl, sulfoethyl, sulfopropyl, of sulfobutyl. As to $X_1$ and $X_2$ both are preferably sulfur. It should be noted that in this application, reference to any "group" indicates that the specified group may be substituted or unsubstituted.

Preferably the dye of formula (I) is of the following formula:

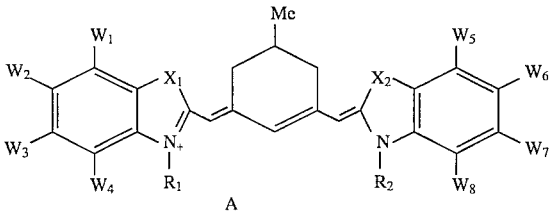

I wherein:

$X_1$, $X_2$, $R_1$, $R_2$ and A are as defined for formula (I) and wherein $W_1$ to $W_8$ each independently represent: hydrogen, a halogen, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, aryloxy group, or heterocyclic group and provided further that adjacent ones of $W_1$ to $W_8$ groups can bond to each other via their carbon atoms to form a condensed ring.

In particular, in the above formula I, $W_1$–$W_8$ may independently be a 1 to 8 carbon alkyl (methyl, ethyl, propyl, butyl or the like), or any of $W_1$–$W_8$ can be a phenyl, any of which may be substituted or unsubstituted, or a hydrogen. In one type of compound of formula I each $W_1$–$W_8$ can independently be hydrogen or methyl. Preferably, $W_1$ to $W_8$ each independently represent a hydrogen atom, an alkyl group (particularly methyl) or an aryl group. At least one of $R_1$ or $R_2$ or both of them is alkyl preferably of 1–8 carbon atoms, either of which alkyl may be substituted or unsubstituted. Examples of such substituents include acid or acid salt groups such as a carboxy, sulfonamido, sulfamoyl, sulfato or sulfo substituent. Thus, either or both $R_1$ and $R_2$ could be, for example, 3-sulfobutyl, 3-sulfopropyl and the like. However, preferably only one of $R_1$ and $R_2$ is substituted with an acid or acid salt group (such that the dye molecule has no net charge, that is, it is a zwitterionic molecule), Preferably the maximum sensitization provided to the emulsion by the dye of formula (I) is greater than 710 nm or even 720 nm. Further, such maximum sensitization is preferably at less than 750 nm (or even 740 or 730 nm). Such maximum sensitization is most preferably in the range of about 720 to 730 nm. By maximum sensitization in this application, is meant the maximum sensitivity of the emulsion as a result of being sensitized only with the sensitizing dye of interest (such as that of formula (I)). An emulsion may be sensitized with additional dyes, such as a red sensitizing dye, so that it has a maximum sensitivity as a result of both dyes, which is not necessarily in the infrared region. Photographic elements containing such sensitized emulsions are still within the scope of the present invention as the emulsion, if sensitized with the infrared sensitizing dye of formula (I) by itself, would have a maximum sensitivity as a result of that dye, in the required infrared region.

A silver halide photographic element according to the present invention may particularly be one wherein the emulsion of the silver halide emulsion layer has not been heated above 50° C. in the presence of a dye of formula I.

As already described, the emulsion layer sensitized by the dye of formula (I) has substantially no dye deaggregating compound therein. By "substantially no dye deaggregating compound" is meant that there is no such compound present in an amount which prevents one from observing formation of a J-aggregate of the dye of formula (I) (it will be understood that reference to a J-aggregate indicates a J-aggregrate of the dye adsorbed to the emulsion). Means for determining the presence of a J-aggregate are well known. In particular, at the time the sensitizing dye is added to the emulsion (or optionally at any time) the emulsion does not contain any substantial amount of stilbene compounds, particularly those of the following formula:

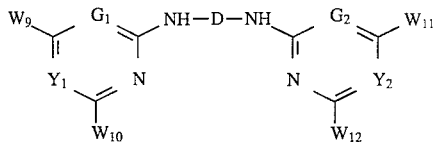

(II)

wherein D is a divalent aromatic moiety; $W_9$–$W_{12}$ each independently represents substituents or hydrogen; $G_1$ and $G_2$ each represents divalent groups, particularly N or CH; $Y_1$ and $Y_2$ each represents divalent groups, particularly N or CH. Lack of a substantial amount of stilbene or other dye deaggregating compounds can be accomplished simply by not adding such compounds to the emulsion. If any trace amounts of them are present, they are preferably in an amount of less than 0.0002 millimoles per mole of silver halide (or even less than 0.0001, 0.00005, 0.00001, or even 0.000001 millimoles per mole of silver halide). The amount of sensitizing dye that is useful in the invention may be from 0.001 to 10 millimoles, but is preferably in the range of 0.05 to 4.0 millimoles per mole of silver halide. Optimum dye concentrations can be determined by methods known in the art.

Dyes of formula I can be prepared according to techniques that are well-known in the art, such as described in Hamer, *Cyanine Dyes and Related Compounds,* 1964 (publisher John Wiley & Sons, New York, N.Y.) and *The Theory of the Photographic Process,* T. H. James, editor, 4th Edition, Macmillan, N.Y., 1977.

Examples of dyes of the present invention are given below in Table I:

TABLE I

Invention Dyes

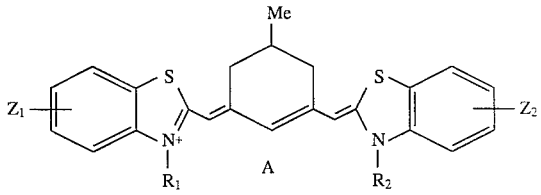

| Dye | $Z_1$ | $Z_2$ | $R_1$ | $R_2$ | A |
|---|---|---|---|---|---|
| I-1 | H | H | 3Sp | Et | — |
| I-2 | 5-Ph | H | 3Sp | 3Sp | $TEAH^+$ |
| I-3 | 5-Ph | H | 3Sp | Et | — |
| I-4 | 6-Me | 6-Me | 4SB | Et | — |
| I-5 | H | 6-Me | 3Sp | Et | — |

3Sp is 3-sulfopropyl, 4SB is 4-sulfobutyl, $TEAH^+$ is triethylammonium, Ph is phenyl, Me is methyl, Et is ethyl.

The photographic elements of the present invention can be black and white, single color elements or multicolor elements. Multicolor elements generally contain dye image-forming units sensitive to different regions of the spectrum. In the present case, any of the elements would have an infrared-sensitive unit which has a silver halide emulsion sensitized by a dye of formula (I), and which unit may optionally also be sensitive to the red region of the spectrum (that is, about 600 to 700 nm) as a result of being sensitized with a red sensitizing dye which by itself provides the emulsion with a maximum sensitivity in the red region. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the different regions of the spectrum can be disposed as a single segmented layer.

A color photographic element generally contains three silver emulsion layers or sets of layers (each set of layers often consisting of emulsions of the same spectral sensitivity but different speed): a light-sensitive layer having a yellow dye-forming color coupler associated therewith; a light-sensitive layer having a magenta dye-forming color coupler associated therewith; and a light-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I* referenced below. That reference and all patents or other references cited in this application are incorporated herein by reference.

The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be infrared-sensitive or red and infrared-sensitive, with other color sensitive layers thereabove ("above" referring to further from the support), such as green-sensitive and blue-sensitive in that order on a transparent support, with the reverse order on a reflective support being typical.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I. The foregoing reference and any other reference cited herein are incorporated by reference in their entirety.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,63 4; 90-077,822; 90-0 78,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. Silver bromide and silver bromoiodide emulsions are particularly useful for the emulsions sensitized with a dye of formula (I). In the case where a high chloride silver halide emulsion is used, the emulsion would contain at least 90% silver chloride or more (for example, at least 95%, 98%, 99% or 100% silver chloride). Some silver bromide may be present. Preferably if there is any iodide present in a high chloride emulsion it constitutes less than 2 mole % of all halide (although this may even be less than 1.5, 1, 0.5 or 0.1 mole %). In particular, the possibility is also contemplated that the silver chloride of a high chloride emulsion could be treated with a bromide source to increase its sensitivity, although the bulk concentration of bromide in the resulting emulsion will typically be no more than about 2 to 2.5% and preferably between about 0.5 to 1.5% (or even 0.5 to 1.0%) the remainder being silver chloride. The foregoing % figures are mole %.

The type of silver halide grains include polymorphic, cubic, octahedral or grains that are non-cubic. The grain size of the silver halide may have any distribution known to be useful in photographic compositions, and may be ether polydipersed or monodispersed. Tabular grain silver halide emulsions are also contemplated in the present invention.

Tabular grains are those with two parallel major faces each clearly larger than any remaining grain face and tabular grain emulsions are those in which the tabular grains account for at least 30 percent, more typically at least 50 percent, preferably 70 percent and optimally >90 percent of total grain projected area. The tabular grains can account for substantially all (>97 percent) of total grain projected area. The tabular grain emulsions can be high aspect ratio tabular grain emulsions, that is emulsions wherein ECD/t>8, where ECD is the diameter of a circle having an area equal to grain projected area and t is tabular grain thickness; intermediate aspect ratio tabular grain emulsions, that is ECD/t=5 to 8; or low aspect ratio tabular grain emulsions, that is ECD/t=2 to 5. The emulsions typically exhibit high tabularity (T), where $T=ECD/t^2$, that is $ECD/t^2>25$, and ECD and t are both measured in micrometers (μm). The emulsion can further have a tabularity of >40 or even >100 or >1000. The tabular silver halide emulsions for the blue sensitive layer preferably have a tabularity of from 25 to 4000, and more preferably from 100 to 1500).

The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum grain surface to volume ratios.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Solberg et al U.S. Pat. No. 4,433,048, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Bando U.S. Pat. No. 4,839,268, Makino et al U.S. Pat. No. 4,853,322, Nishikawa et al U.S. Pat. No. 4,952,491, Houle et al U.S. Pat. No. 5,035,992, Piggin et al U.S. Pat. Nos. 5,061,609 and 5,061,616, Nakamura et al U.S. Pat. No. 5,096,806, Bell et al U.S. Pat. No. 5,132,203, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Antoniades et al U.S. Pat. No. 5,250,403, Zola et al EPO 0 362 699, Maruyama et al EPO 0 431 585, Urabe EPO 0 460 656, Verbeek EPO 0 481 133, 0 503 700 and 0 532 801, Jagannathan et al EPO 0 515 894 and Sekiya et al EPO 0 547 912. Emulsions containing {100} major face tabular grains are illustrated by Bogg U.S. Pat. No. 4,063,951, Mignot U.S. Pat. No. 4,386,156, Maskasky U.S. Pat. Nos. 5,264,337 and 5,275,930, Brust et al EPO 0 534 395 and Saitou et al EPO 0 569 971.

The silver halide grains to be used in the invention may be prepared according to methods known in the art, such as those described in *Research Disclosure I* and James, *The Theory of the Photographic Process,* or U.S. Pat. No. 4,439,520 for precipitation of iodobromide tabular grains (these references and all other references cited herein are incoporated in their entirety by reference to them). These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, gold, platinum, palladium, iridium, osmium, rhenium, phosphorous, or combinations thereof. In preferred embodiments of the present invention, sensitization is conducted in the absence of tellurium. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes of formula I by any method known in the art, such as described in *Research Disclosure I.* Of course, various layers of photographic elements of the present invention may use sensitizing dyes other than those of formula I, but a dye of formula I will be present in at least one layer as a sensitizing dye. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVIII. This typically involves exposure to light in the infrared region of the spectrum and includes exposure to a real-time image (that is, a live image) through a lens, or alternatively exposure to a stored image, such as a computer stored image, by exposure with light emitting devices such as light emitting diodes or lasers.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. In the case of processing a reversal color element, the element is first treated with a black and white developer followed by fogging of the silver halide (chemically or by light), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(βhydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The invention is described further in the following examples. Comparison dyes used in the Examples below are defined in the following Table II:

TABLE II

Comparison Dyes

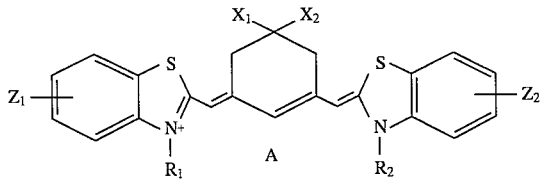

| Dye | Z1 | Z2 | X1 | X2 | R1 | R2 | A |
|---|---|---|---|---|---|---|---|
| C-1 | H | H | Me | Me | 3Sp | Et | — |
| C-2 | H | H | H | H | 3Sp | Et | — |
| C-3 | H | H | Me | H | Et | Et | $BF4^-$ |
| C-4 | 6-Me | 6-Me | Me | H | Et | Et | $I^-$ |
| C-8 | H | H | Ph | H | Et | Et | $I^-$ |
| C-9 | Ph | H | H | H | 3Sp | Et | — |

(C-5)

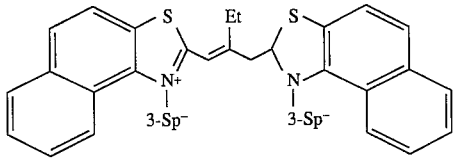

(C-6)

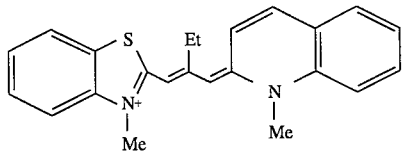

(C-7)

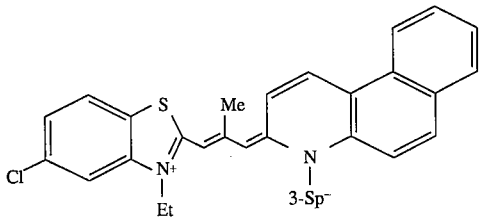

TABLE II-continued

Comparison Dyes

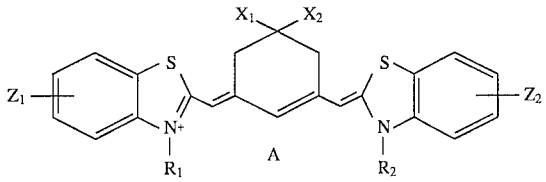

| Dye | Z1 | Z2 | X1 | X2 | R1 | R2 | A |
|---|---|---|---|---|---|---|---|
| (C-10) | | | | | | | |

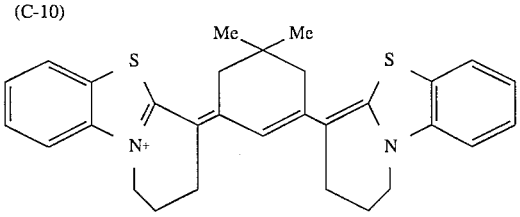

(C-11)

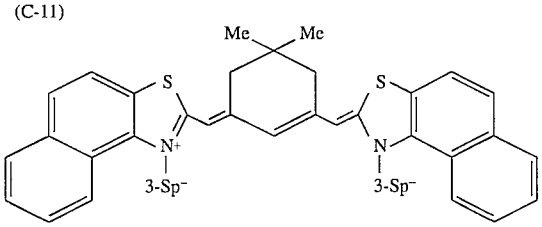

PHOTOGRAPHIC EXAMPLE I

Black and white photographic materials were prepared by coating a polyester support with a silver halide emulsion layer containing chemically-sensitized 0.2 um cubic silver bromoiodide (2.6 mol % I, Emulsion I) at 10.8 mg Ag/dm$^2$, hardened gelatin at 73 mg/dm$^2$, and sensitizing dye as identified in the Table III at 0.8 mmole/mole Ag. The elements were given a wedge spectral exposure and processed in RP X-OMAT chemistry (a developer containing hydroquinone and p-methylaminophenol as developing agents).

The photographic speed of the dyes is reported (Table III) in terms of a sensitizing ratio (SR), which is defined as the speed at λ-max (in log E units multiplied by 100) minus the intrinsic speed of the dyed emulsion at 400 nm (in log E units multiplied by 100) plus 200. This measurement of speed allows for comparison while using a uniform chemical sensitization that is not optimized for each sensitizing dye. The dye peak maxima was measured spectrophotometrically on unexposed, unprocessed films. These peak positions corresponded with peak photographic sensitivity wavelengths but could be determined more precisely.

TABLE III

| Dye | γ-max Sens (nm) | SR at 1-max |
|---|---|---|
| I-1 | 737 | 197 |
| I-2 | 729 | 207 |
| I-3 | 730 | 209 |
| I-4 | 723 | 182 |
| I-5 | 732 | 209 |

TABLE III-continued

| Dye | γ-max Sens (nm) | SR at 1-max |
|---|---|---|
| C-1 | 699 | 165 |
| C-2 | 578, 670s* | 186, 180 |
| C-3 | 700 | 173 |
| C-4 | 692 | 136 |
| C-8 | 690 | 129 |
| C-9 | 612 | 218 |
| C-10 | 740 | 156 |
| C-11 | 750 | 132 |

s* is secondary peak.

The invention dyes sensitize in the infrared with good speed. The comparison dyes such as C-9 ,C-10, C-11 (described in EP 531 759), although they have structures close to the invention dyes, either do not give a maximum sensitivity in the infrared or are not efficient infrared sensitizers.

PHOTOGRAPHIC EXAMPLES II AND III

The dyes identified in Table IV were compared on two silver halide emulsions of differing morphology and halide composition. Emulsion II was a polydisperse, polymorphic AgBrI (96/4) emulsion with an average equivalent spherical diameter of approximately 0.8 microns. Emulsion III was a monodisperse AgBr cubic emulsion with an average equivalent spherical diameter of 0.9 microns. Emulsions II and III were chemically sensitized with gold and sulfur; Emulsion III was additionally sensitized with selenium. Emulsion III was then treated with 75 mg/Ag mole of potassium iodide added from a dilute aqueous solution. Each emulsion was dyed with 0.1 mmole/Ag mole of sensitizing dye, treated with 500 mg/Ag mole of 5-carboxy-6-methyl-2-methylmercaptotetraazaindene and coated on polyester film support at a silver laydown of 200 mg/sq.ft.and a gel laydown of 400 mg/sq.ft. An overcoat of 120 mg/sq.ft. of gelatin was applied and the layers were hardened using 1,1'-[methylenebis(sulfonyl)]bis-ethene at 2% weight with respect to the gelatin.

The coatings were given a tungsten 3000 K+Wratten 89B and spectrographic exposures. The Wratten 89B filter cuts out essentially all light with a wavelength shorter than 690 nm and therefore measures the infrared sensitivity of the individual films. The films were then RP XOMAT processed. Speeds were measured on a logarithmic scale such that a speed of 130 indicates a speed twice as fast as a speed of 100.

C-5 is a common red sensitizing dye, which, although providing excellent long red spectral sensitization, yields poor infrared (Wratten 89B) speeds due to the sharp falloff in sensitivity beyond the peak maximum.

C-6 and C-7 are described in U.S. Pat. No. 3,615,634. On Emulsion II, both comparison dyes showed peak sensitivity at only 700 nm, which limited their infrared speed capability. I-1 showed two distinct sensitization peaks at 685 and 732 nm yielding a broad red—infrared sensitization. I-3 yielded a strong single sensitization peak at 721 nm.

Comparison dyes C-5, C-6, and C-7 had peak sensitivities of 683, 730, and 720 nm respectively on the cubic emulsion (Emulsion III). Thus two of the comparison dyes had maximum sensitivity in the infrared, however, the photographic speed imparted by the comparison dyes was inferior relative to the invention dyes I-1 and I-3 which sensitized at 738 and nm respectively. The comparison dyes show greater sensitivity to emulsion morphlogy relative to the invention dyes.

TABLE IV

| Emulsion | Emulsion Type | Dye | WRATTEN 89B Speed | 1-max Sens (nm) |
|---|---|---|---|---|
| II | BrI poly | None | — | — |
| " | " | C-5 | 62 | 673 |
| " | " | C-6 | 114 | 700 |
| " | " | C-7 | 96 | 702 |
| " | " | I-1 | 154 | 685 732 |
| " | " | I-3 | 144 | 721 |
| III | Br cube | None | — | — |
| " | " | C-5 | 56 | 683 |
| " | " | C-6 | 202 | 730 |
| " | " | C-7 | 178 | 717 |
| " | " | I-1 | 208 | 738 |
| " | " | I-3 | 222 | 727 |

While the invention has been described in detail with particular reference to preferred embodiments, it will be understood that variations and modifications can be effected within the spirit and scope of the invention.

We claim:

1. A silver halide photographic element comprising a silver halide emulsion layer, in which the silver halide is silver bromide or bromoiodide, chemically sensitized in the absence of tellurium with a chemical sensitizer selected from active gelatin, sulfur, selenium, gold, platinum, palladium, iridium, osmium, ruthenium, phosphorus, or combinations thereof, and sensitized with a sensitizing dye of formula (I) which provides a maximum sensitivity at between 700 to less than 730 nm and which emulsion layer has substantially no dye deaggregating compound therein:

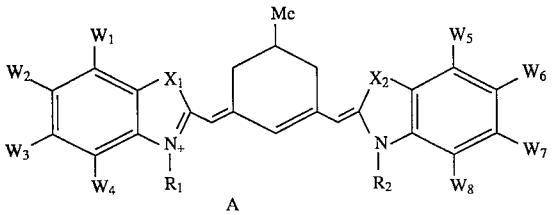

I

A wherein:

$X_1$ and $X_2$ are independently sulfur, selenium or oxygen provided that $X_1$ and $X_2$ are not both oxygen;

$R_1$ and $R_2$ each independently represent an alkyl, aryl or heterocyclic group and at least one of $R_1$ or $R_2$ has an acid or acid salt substituent;

$W_1$ to $W_3$, and $W_5$ to $W_7$ each independently represent hydrogen, a halogen, an alkyl group, an acyl group, an acyloxy group, an alkoxycarbonyl group, a carbonyl group, a sulfamoyl group, carboxyl group, cyano group, hydroxy group, an amino group, an acylamino group, an alkoxy group, an alkylthio group, an alkylsulfonyl group, sulfonic acid group, aryl group, aryloxy group, or heterocyclic group, and $W_4$ and $W_8$ each independently represent hydrogen, a halogen, an acyl group, an acyloxy group, an alkoxycarbonyl group, a carbonyl group, a sulfamoyl group, carboxyl group, cyano group, hydroxy group, an amino group, an acylamino group, an alkylthio group, an alkylsulfonyl group, sulfonic acid group, aryl group, or heterocyclic group, and provided further that adjacent ones of $W_1$ to $W_8$ groups can bond to each other via their carbon atoms to form a condensed ring; and A is a counterion as needed to balance the charge.

2. A silver halide photographic element according to claim 1 wherein only one of $R_1$ and $R_2$ has an acid or acid salt substituent when either of the benzo rings shown does not have an aromatic or heterocyclic substituent.

3. A silver halide photographic material according to claim 1 wherein $W_1$ to $W_3$, and $W_5$ to $W_7$ each independently represent a hydrogen atom, an alkyl group or an aryl group, and $W_4$ and $W_8$ each independently represent a hydrogen atom.

4. A silver halide photographic element according to claim 3 wherein $W_1$ to $W_3$, and $W_5$ to $W_7$ independently represent hydrogen, methyl or aryl.

5. A silver halide photographic element according to claim 3 wherein $R_1$ and $R_2$ are selected from unsubstituted alkyl or alkyl substituted by an acid or acid salt substituent.

6. A silver halide photographic element according to claim 1 wherein only one of $R_1$ or $R_2$ has an acid or an acid salt substituent.

7. A silver halide photographic element according to claim 6 wherein $R_1$ and $R_2$ are selected from unsubstituted alkyl or alkyl substituted by an acid or acid salt substituent.

8. A silver halide photographic element according to claim 1 wherein $X_1$ and $X_2$ can independently be sulfur or selenium.

9. A silver halide photographic element according to claim 1 wherein $X_1$ and $X_2$ are both sulfur.

10. A silver halide photographic element according to claim 1 wherein $R_1$ and $R_2$ are both alkyl groups only one of which is substituted by an acid or acid salt substituent.

11. A silver halide photographic material according to claim 1 wherein the silver halide emulsion layer has not been heated above 50° C. in the presence of a dye of formula I.

12. A silver halide photographic material according to claim 1 wherein the dye of formula I provides a maximum sensitivity of greater than 710 nm but less than 730 nm.

13. A silver halide photographic material according to claim 1 wherein the photographic element contains a silver halide emulsion having noncubic morphology.

14. A silver halide photographic material according to claim 1 wherein said photographic material includes at least two silver halide emulsion layers both sensitized to have a maximum sensitivity at greater than 700 nm and which maximum sensitivities of the two layers differ by at least 30 nm.

15. A silver halide photographic element according to claim 1 wherein $R_1$ and $R_2$ are selected from unsubstituted alkyl or alkyl substituted by an acid or acid salt substituent.

16. A silver halide photographic element according to claim 15 wherein $R_1$ and $R_2$ are selected from unsubstituted alky or alkyl substituted by carboxy, sulfonamido, sulfamoyl, sulfato or sulfo.

* * * * *